US008617685B2

(12) United States Patent
Yamada

(10) Patent No.: US 8,617,685 B2
(45) Date of Patent: Dec. 31, 2013

(54) CLEANING SHEET

(76) Inventor: Daisaku Yamada, Tokyo (JP)

( * ) Notice: Subject to any disclaimer, the term of this patent is extended or adjusted under 35 U.S.C. 154(b) by 767 days.

(21) Appl. No.: 12/449,509

(22) PCT Filed: Feb. 6, 2008

(86) PCT No.: PCT/JP2008/051946

§ 371 (c)(1),
(2), (4) Date: Aug. 11, 2009

(87) PCT Pub. No.: WO2008/099733

PCT Pub. Date: Aug. 21, 2008

(65) Prior Publication Data

US 2010/0015383 A1 Jan. 21, 2010

(30) Foreign Application Priority Data

Feb. 13, 2007 (JP) ..... 2007-031479
Mar. 12, 2007 (JP) ..... 2007-061276

(51) Int. Cl.

| | |
|---|---|
| ***A47L 13/16*** | (2006.01) |
| ***B32B 33/00*** | (2006.01) |
| ***B32B 3/14*** | (2006.01) |
| ***B32B 3/16*** | (2006.01) |

(52) U.S. Cl.
USPC ..... 428/89; 428/91; 428/92; 428/195.1; 428/131; 15/208; 15/209.1

(58) Field of Classification Search
USPC ..... 428/91, 195.1, 131, 89, 88, 92; 15/208, 15/209.1, 228, 229.3, 229.7, 229.1, 226
See application file for complete search history.

(56) References Cited

U.S. PATENT DOCUMENTS

| | | | | | |
|---|---|---|---|---|---|
| 3,855,046 | A * | 12/1974 | Hansen et al. | ..... | 428/198 |
| 4,088,726 | A * | 5/1978 | Cunbers | ..... | 264/123 |
| 4,333,979 | A * | 6/1982 | Sciaraffa et al. | ..... | 428/179 |
| 6,143,393 | A * | 11/2000 | Abe et al. | ..... | 428/131 |
| 6,241,835 | B1 * | 6/2001 | Abe et al. | ..... | 156/73.2 |
| 6,329,308 | B1 * | 12/2001 | Kenmochi et al. | ..... | 442/394 |
| 6,537,644 | B1 * | 3/2003 | Kauschke et al. | ..... | 428/103 |
| 6,589,638 | B1 * | 7/2003 | McCormack et al. | ..... | 428/198 |
| 6,813,801 | B2 * | 11/2004 | Tanaka et al. | ..... | 15/229.3 |

(Continued)

FOREIGN PATENT DOCUMENTS

| | | |
|---|---|---|
| JP | A-2000-245670 | 9/2000 |
| JP | A-2000-296084 | 10/2000 |
| JP | A-2004-223692 | 8/2004 |
| WO | WO 2006/070502 A1 | 7/2006 |

*Primary Examiner* — Cheryl Juska
(74) *Attorney, Agent, or Firm* — Oliff & Berridge, PLC

(57) ABSTRACT

Conventional cleaning sheets having brush parts provided on a surface of substratum sheet have been satisfactory in the trapping of dirt or dust at the brush parts but unsatisfactory in the trapping of dirt or dust at areas between brush parts where no brush is present. It is intended to provide a cleaning sheet with which any dirt or dust having sneaked through areas between brush parts and remaining untrapped can be trapped by brush parts provided in alternately positioning relationship adjacent to the brush parts, thereby attaining effective cleaning. The cleaning sheet comprises a sheet substratum and, disposed on at least one major surface thereof, multiple brush part lines each provided with multiple brush parts arranged intermittently along one direction of the sheet substratum, the multiple brush part lines arranged in a direction intersecting with the one direction, and that mutually adjacent brush part lines are provided so that the respective brush parts are alternately positioned.

16 Claims, 9 Drawing Sheets

(56) References Cited

U.S. PATENT DOCUMENTS

| | | | | |
|---|---|---|---|---|
| 6,830,801 | B1 * | 12/2004 | Kenmochi et al. | 428/136 |
| 6,984,615 | B2 * | 1/2006 | Kenmochi et al. | 510/295 |
| 7,127,975 | B2 | 10/2006 | Miyatake et al. | |
| 7,228,587 | B2 * | 6/2007 | Tanaka et al. | 15/229.3 |
| 7,231,685 | B2 * | 6/2007 | Tanaka et al. | 15/229.3 |
| 7,234,193 | B2 * | 6/2007 | Tanaka et al. | 15/229.3 |
| 7,234,194 | B2 * | 6/2007 | Tanaka et al. | 15/229.3 |
| 7,237,296 | B2 * | 7/2007 | Tanaka et al. | 15/229.3 |
| 7,237,297 | B2 * | 7/2007 | Tanaka et al. | 15/229.3 |
| 7,243,391 | B2 * | 7/2007 | Tanaka et al. | 15/229.3 |
| 7,243,585 | B2 | 7/2007 | Miyatake et al. | |
| 7,252,870 | B2 * | 8/2007 | Anderson et al. | 428/152 |
| 7,255,766 | B2 * | 8/2007 | Kenmochi et al. | 156/251 |
| 7,302,729 | B2 * | 12/2007 | Tanaka et al. | 15/229.3 |
| 7,302,730 | B2 * | 12/2007 | Tanaka et al. | 15/229.3 |
| 7,334,287 | B2 * | 2/2008 | Tanaka et al. | 15/229.3 |
| 7,404,227 | B2 * | 7/2008 | Otsuka et al. | 15/228 |
| 7,566,671 | B2 * | 7/2009 | Hoadley et al. | 442/381 |
| 7,610,618 | B2 * | 10/2009 | Patrick | 726/7 |
| 7,803,244 | B2 * | 9/2010 | Siqueira et al. | 156/229 |
| 7,905,871 | B2 * | 3/2011 | Mueller et al. | 604/385.201 |
| D648,089 | S * | 11/2011 | Otsuka et al. | D32/40 |
| D648,090 | S * | 11/2011 | Otsuka et al. | D32/40 |
| 8,146,197 | B2 * | 4/2012 | Yamada | 15/229.3 |
| 2002/0042962 | A1 * | 4/2002 | Willman et al. | 15/208 |
| 2002/0050016 | A1 * | 5/2002 | Willman et al. | 15/104.002 |
| 2004/0149095 | A1 * | 8/2004 | Miyatake et al. | 83/37 |
| 2007/0107156 | A1 * | 5/2007 | Willman et al. | 15/228 |
| 2007/0190878 | A1 * | 8/2007 | Willman et al. | 442/151 |
| 2008/0148508 | A1 | 6/2008 | Yamada | |

* cited by examiner 1 cleaning sheet
2 sheet substrate
3 brush parts
3a brush part lines 5 sheet-like fiber
6a, 6b planar seal parts
7 cut

CLEANING SHEET

TECHNICAL FIELD

The present invention relates to a cleaning sheet that can be used for wiping off dirt, dust and the like attached on the surfaces of floors, walls and the like in various places such as houses, factories, hospitals and stores.

BACKGROUND ART

Conventionally, cleaning tools such as brooms, mops and wiping clothes have been used for removing crumbs of foods such as bread crumbs on the floor, hairs, cotton dust, dust attached to walls and the like. In recent years, cleaning tools having a base with a handle, and a cleaning sheet constituted by nonwoven fabric or the like attached on the base, wherein the cleaning sheet can be detached and replaced with a new sheet when the sheet become dirty, have been widely used. Recently, as a cleaning sheet used for this kind of cleaning tool, those constituted by a sheet substrate such as nonwoven fabric and fibers are used. For example, a cleaning sheet including a substrate sheet, and many brushes constituted by a combination of long brushes and short brushes on the surface of the substrate sheet that are formed by bonding long fibers on the surface of the substrate sheet by multiple linear fusion-bonding parts that are intermittently disposed in the fiber direction and cutting the long fibers at the positions other than the centers between the linear fusion-bonding parts (Patent Document 1), a cleaning sheet including a substrate sheet, and brushes that are formed by bonding long fibers on the surface of the substrate sheet by multiple linear fusion-bonding parts that are intermittently disposed in the fiber direction and intermittently cutting the multiple fibers between the linear fusion-bonding parts in the direction of the linear fusion-bonding parts (Patent Document 2), and the like are known.

Patent Document 1: Japanese Patent Application Laid-Open No. 2000-245670

Patent Document 2: Japanese Patent Application Laid-Open No. 2000-296084

DISCLOSURE OF THE INVENTION

Problem to be Solved by the Invention

Since the brushes are formed by cutting the fibers continuously or intermittently along the linear fusion-bonding parts that are intermittently disposed on the cleaning sheets described in the above-mentioned Patent Documents 1 and 2, belt-like brushes are formed, and each linear fusion-bonding part is interposed by these brushes. Therefore, there was a problem that dirt and dust can be trapped by the belt-like brush parts but cannot be trapped sufficiently by the parts where no brush is present between the belt-like brushes. The present invention aims at providing a cleaning sheet that can solve the above-mentioned conventional problems.

Means for Solving the Problem

Namely, the gist of the present invention is as follows:

(1) a cleaning sheet including a sheet substrate and multiple brush part lines disposed on at least one surface of the sheet substrate, wherein each brush part line has multiple brush parts disposed intermittently along one direction of the sheet substrate, the multiple brush part lines are disposed in a direction intersecting with the direction, and the adjacent brush part lines are disposed so that the mutual brush parts are alternately positioned, (2) the cleaning sheet according to the above-mentioned (1), wherein the sheet-like fibers are superposed on at least one surface of the sheet substrate; first seal part groups in which each group is constituted by multiple planar seal parts disposed intermittently along the fiber direction of the sheet-like fibers, and second seal part groups in which each group is constituted by planar seal parts disposed intermittently on the positions intersecting with the planar seal parts of the first seal part groups, are disposed in an alternate manner in a direction intersecting with the fiber direction of the sheet-like fibers to join the sheet substrate and the sheet-like fibers; and cuts each having a width similar to or lower than the width of the planar seal part are provided between the planar seal parts in each seal part group to cut the fibers to form the brush parts around the planar seal parts, (3) the cleaning sheet according to the above-mentioned (1), wherein the sheet-like fibers are superposed on at least one surface of the sheet substrate; first seal part groups in which each group is constituted by multiple planar seal parts disposed intermittently along the fiber direction of the sheet-like fibers, and second seal part groups in which each group is constituted by planar seal parts disposed intermittently on the positions intersecting with the planar seal parts of the first seal part groups, are disposed in an alternate manner in a direction intersecting with the fiber direction of the sheet-like fibers to join the sheet substrate and the sheet-like fibers; cuts each having a width similar to or lower than the width of the planar seal parts on the second seal part groups in which each group is interposed between the first seal part groups, are provided between the planar seal parts on the adjacent two first seal part groups by which the second seal part group is interposed, in a direction intersecting with the fiber direction of the seat-like fibers to cut the fibers to form the brush parts around the planar seal parts; and cuts each having a width similar to or lower than the width of the planar seal parts on the first seal part groups in which each group is interposed between the second seal part groups, are provided between the planar seal parts on the adjacent two second seal part groups by which the first seal part group is interposed, in a direction intersecting with the fiber direction of the seat-like fibers to cut the fibers to form the brush parts around the planar seal parts, (4) the cleaning sheet according to the above-mentioned (2) and (3) wherein the first seal part groups and the second seal part groups are disposed so that the planar seal parts on the first seal part groups and the planar seal parts on the second seal part groups are formed on the positions that are mutually overlapped on the upper and lower positions along the fiber direction of the sheet-like fibers, (5) the cleaning sheet according to any one of the above-mentioned (2) to (4), wherein the brush parts are formed into cotton-like shape by spreading the fibers in the brush parts after formation of the brush parts around the seal parts, (6) the cleaning sheet according to any one of the above-mentioned (2) to (5), wherein the sheet substrate and the sheet-like fibers are joined by disposing planar seal parts having different sizes, (7) the cleaning sheet according to the above-mentioned (6), wherein the planar seal parts have different sizes in the direction along the fiber direction of the sheet-like fibers, (8) the cleaning sheet according to the above-mentioned (6), wherein the planar seal parts have different sizes in the direction intersecting with the fiber direction of the sheet-like fibers, and (9) the cleaning sheet according to any one of the above-mentioned (2) to (8), wherein the planar seal parts each has an oval shape.

Effect of the Invention

Since the cleaning sheet of the present invention is constituted so as to have multiple brush part lines each having multiple brush parts intermittently along one direction of the surface of the sheet substrate in a direction intersecting with the above-mentioned direction and mutual brush parts of the adjacent brush part lines being alternately positioned, dirt and dust are trapped between the multiple fibers in one brush part or between the adjacent brush parts, and dirt and dust having sneaked through between the intermittently disposed brush parts and remaining untrapped can be trapped by the brush parts that are alternately positioned on the adjacent brush part lines. Therefore, effective cleaning can be performed without failing to trap fine dirt and dust. Furthermore, by joining the sheet substrate and sheet-like fibers by planar seal parts having different sizes and cutting the fibers by providing cuts between the planar seal parts to form the brush parts around the planar seal parts, brush parts having shorter fiber length than the fiber length of the brush parts formed around the small planar seal parts are formed around the large planar seal parts, whereby the brush parts having short fiber length exhibit excellent effect by scraping out dirt and dust, and the brush parts having long fiber length exhibit excellent effect by trapping the dirt and dust having been scraped out. Moreover, when each planar seal part is formed into an oval shape, a brush part having fibers with different lengths is formed around one seal part. The short fibers scrape out dirt and dust and the long fibers trap the dirt and dust having scraped out, whereby one brush part exhibits excellent effects in both scraping out and trapping of dirt and dust.

EXPLANATION OF REFERENCE NUMERALS

1 cleaning sheet
2 sheet substrate
3 brush parts
3*a* brush part lines
5 sheet-like fiber
6*a* and 6*b* planar seal parts
7 cut
9*a* and 9*b* fiber seal ends
10*a* and 10*b* fiber ends

BEST MODE FOR CARRYING OUT THE INVENTION

Figure 1:
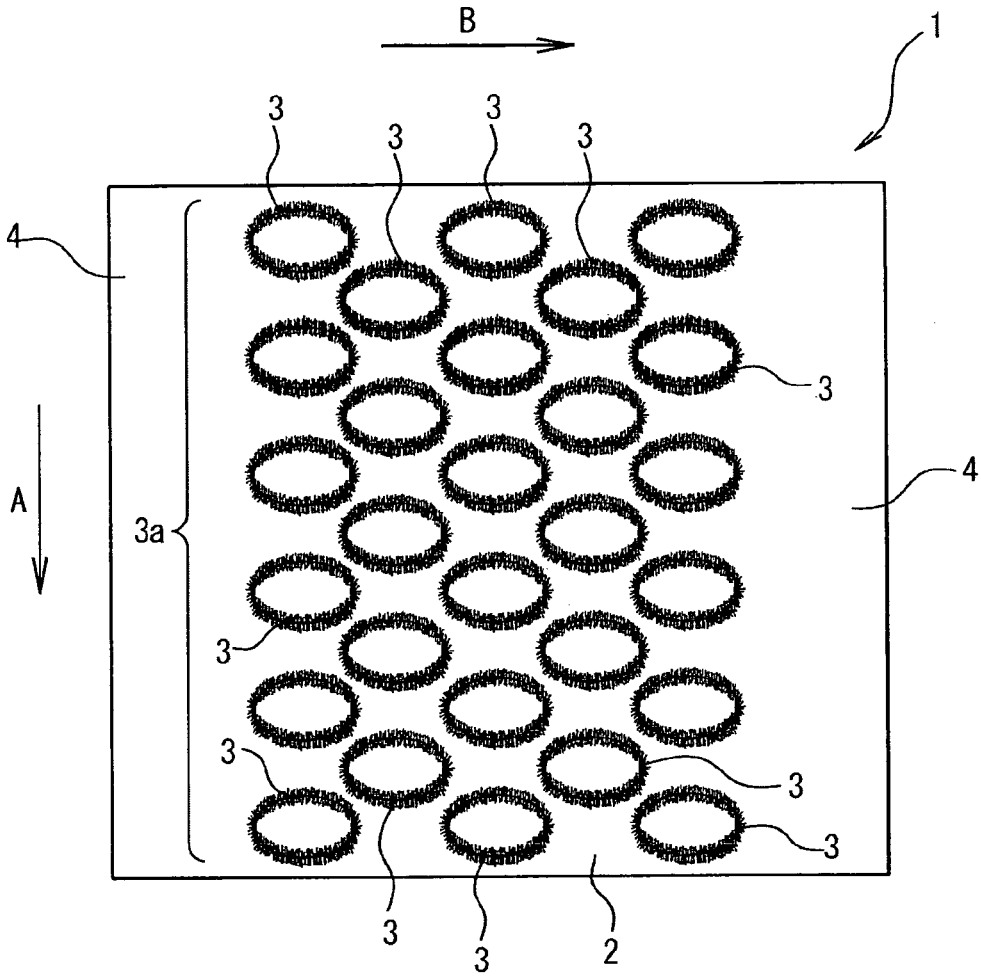
FIG. 1 is a plane drawing showing one example of the cleaning sheet of the present invention.

FIG. 1 shows an example of the cleaning sheet 1 of the present invention that is constituted to be used after being attached to a floor cleaning tool, wherein the cleaning sheet 1 is constituted to have sheet substrate 2 and multiple brush parts 3 disposed on the surface of the sheet substrate 2. In the brush parts 3, multiple brush part lines 3*a* each having multiple brush parts 3 intermittently disposed in one direction (the direction of the arrow A in FIG. 1) of the sheet substrate 2 are disposed in the direction intersecting with the above-mentioned direction (the direction of the arrow B in FIG. 1), and the mutually adjacent brush part lines 3*a* are disposed so that the respective brush parts 3 are alternately positioned. The brush parts 3 may be formed only on one surface or both surfaces of the sheet substrate. Both end parts 4 of the above-mentioned cleaning sheet 1 are parts with which the sheet is attached to the floor cleaning tool.

The sheet substrate 2 in the cleaning sheet 1 of the present invention may be constituted by a sheet such as paper, synthetic resin and nonwoven fabric, but nonwoven fabric is preferable. Examples of the nonwoven fabric may include spun lace nonwoven fabric, spun bond nonwoven fabric, thermal bond nonwoven fabric, air through nonwoven fabric, point bond nonwoven fabric and the like, but spun bond nonwoven fabric and thermal bond nonwoven fabric are preferable. The fibers for constituting the nonwoven fabric may be any of natural fibers, synthesis fibers and composite fibers. The nonwoven fabric is preferably one having a basis weight of about 20 $g/m^2$ to 100 $g/m^2$. As the synthesis resin, for example, sheets of polyethylene, polypropylene and the like are used. The sheet substrate 2 is not limited to one constituted by one sheet, and may be constituted by stacking two or more sheets. When the sheet substrate 2 is constituted by stacking multiple sheets, it is not limited to a stack of same kind of sheets, and a stack of sheets having different materials and colors may also be used.

As the fibers that constitute the brush parts 3, for example, natural fibers such as cotton and wool, synthetic fibers such as polyethylene, polypropylene, polyethylene terephthalate, nylon and polyacrylic, composite fibers such as sheath-core type fibers, sea-island type fibers and side-by-side type fibers, and the like are used, and those capable of adhering to the sheet substrate 2 by heat-melting are preferable. Of these, sheath-core type composite fibers including polypropylene as a core and polyethylene as a sheath are preferable since they have both excellent heat-melt adhesion property due to the polyethylene that constitutes the sheath and strong elasticity due to the polypropylene that constitutes the core. As the fibers, those having a diameter of about 0.01 mm to 0.3 mm are used, and the fibers may be constituted by fibers of the same material, diameter, color and the like, or may be constituted by two or more fibers having different material, diameter, color and the like.

Figure 2:
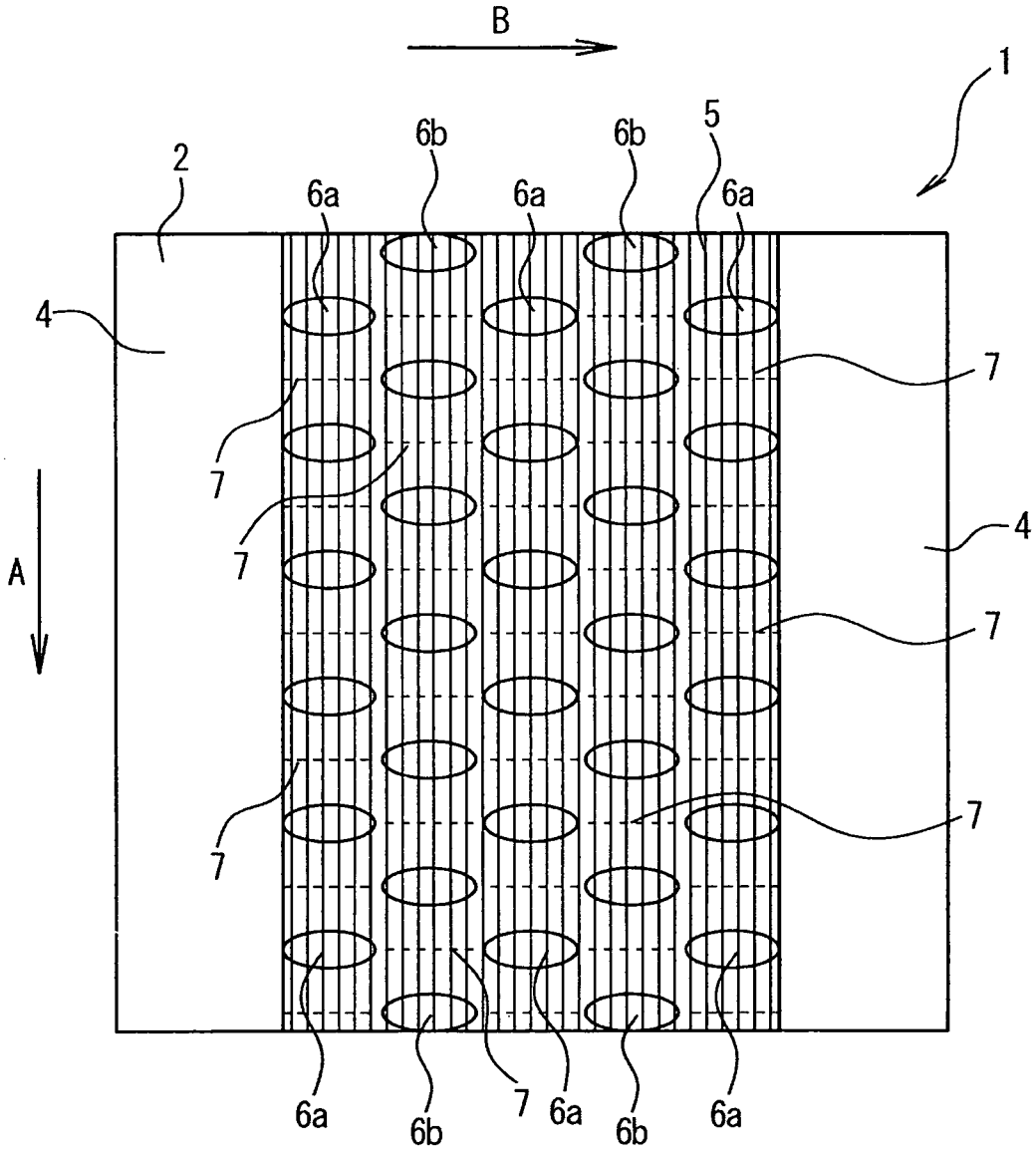
FIG. 2 is a plane drawing showing one example of the production process of the cleaning sheet of the present invention.

When the brush parts 3 are formed by fibers having heat-seal property with the sheet substrate 2, the brush parts 3 may be formed, as shown in FIG. 2, by superposing the sheet-like fibers 5 consisting of long fibers on the sheet substrate 2;

providing first seal part groups each having multiple planar seal parts 6*a* disposed by heat-sealing intermittently along the fiber direction of the sheet-like fibers 5 (the direction of the arrow A in FIG. 2), and second seal part groups each having multiple seal parts 6*b* disposed intermittently so that each seal part 6*b* is positioned between the planar seal part 6*a* and planar seal part 6*a* on the first seal part groups in an alternate manner in a direction intersecting with the fiber direction of the sheet-like fibers 5 (the direction of the arrow B in FIG. 2) to join the sheet-like fibers 5 and the sheet substrate 2; and providing cuts 7 each having a width similar to or lower than the width of the planar seal part, between each planar seal parts 6*a* and 6*a*, and 6*b* and 6*b*, to cut the fibers in the sheet-like fibers 5. When the fibers that constitute the brush parts 3 are not heat-sealable with the sheet substrate 2, the planar seal parts 6*a* and 6*b* may be formed using an adhesive instead of using heat-sealing. Alternatively, when the fibers that constitute the brush parts 3 are heat-sealable with the sheet substrate 2, the planar seal parts 6*a* and 6*b* may be formed using an adhesive. Alternatively, the planar seal parts 6*a* and 6*b* may be formed using heat-sealing and adhesion in combination. In this case, for example, the fibers in the sheet-like fibers 5 may be joined intermittently by heat-sealing and the sheet-like fiber 5 and the sheet substrate 2 may be joined by adhesion, or the fibers in the sheet-like fibers 5 may be joined intermittently by adhesion and the sheet-like fiber 5 and the sheet substrate 2 may be joined by heat-sealing when the fibers are heat-sealable with the sheet substrate, but it is preferable to join the fibers in the sheet-like fibers 5 by heat-sealing and join the sheet-like fiber 5 and the sheet substrate 2 by adhesion. Not only when the planar seal parts 6*a* and 6*b* are formed by using heat-sealing and adhesion in combination but also when they are formed by using the same method, joining of the fibers in the sheet-like fibers 5 and joining of the sheet-like fibers 5 and the sheet substrate 2 may be performed separately. In this case, it is necessary to join so that the positions on which the sheet-like fibers 5 are intermittently joined and the positions on which the sheet-like fibers 5 and the sheet substrate 2 are intermittently joined are identical. It is preferable that the interval between the planar seal parts 6*a* in the first seal part groups and the interval between the planar seal parts 6*b* in the second seal part groups are each about 20 mm to 60 mm. The interval between the planar seal parts 6*a* in the first seal part groups and the interval between the planar seal parts 6*b* in the second seal part groups may be each the same or different, but it is necessary to dispose the planar seal parts 6*a* in the first seal part group and the planar seal parts 6*b* in the second seal part groups that are disposed to be adjacent to the first seal part group at intervals so that the planar seal parts 6*a* and 6*b* are alternately positioned.

Figure 3A:
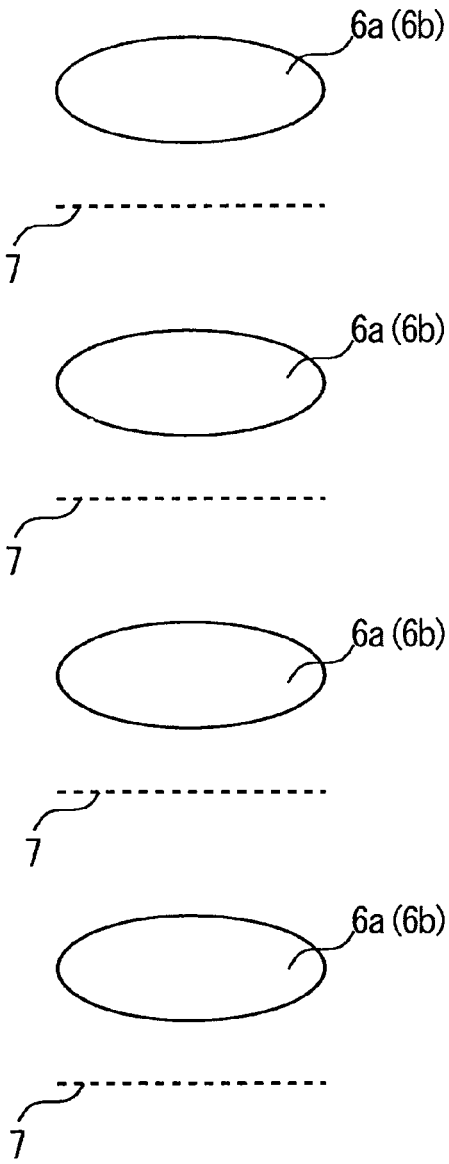
FIG. 3 is an explanatory drawing showing embodiments where the positions on which the cuts are provided between the planar seal parts are different.
Figure 3B:
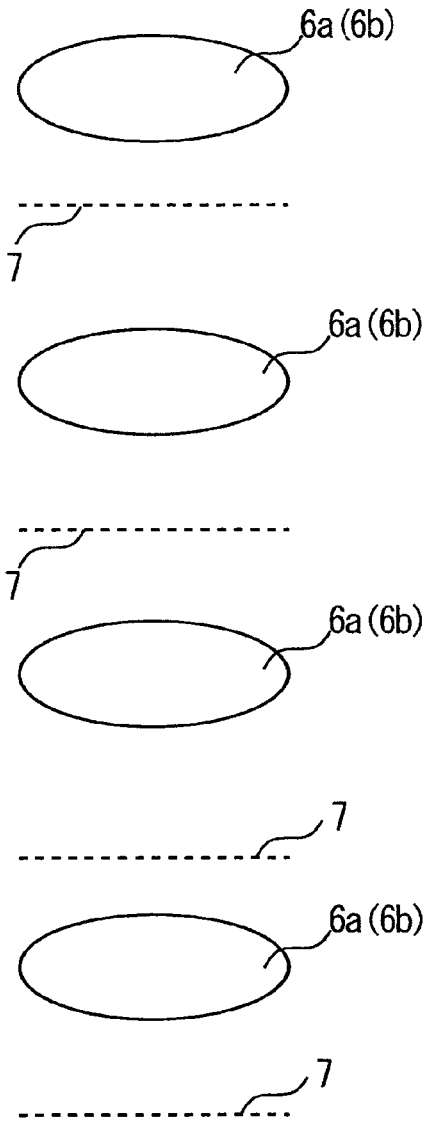
Figure 4:
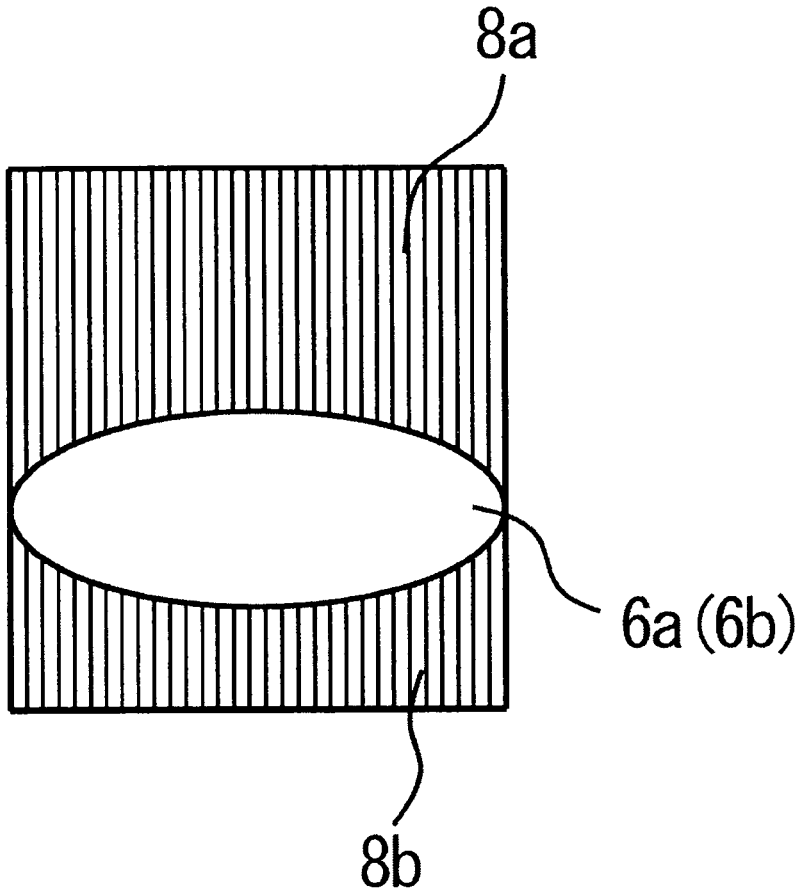
FIG. 4 is an explanatory drawing showing the brush part formed around the planar seal part.
Figure 5A:
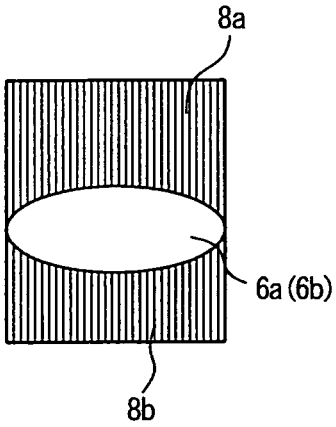
FIG. 5 is an explanatory drawing showing embodiments having different brush parts formed around the planar seal parts.
Figure 5B:
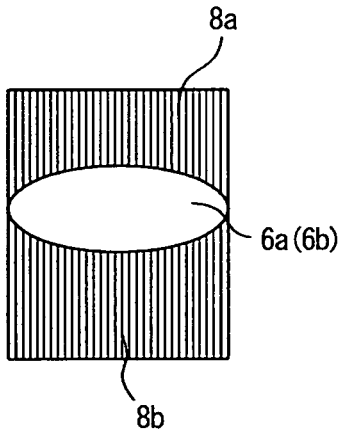
Figure 5C:
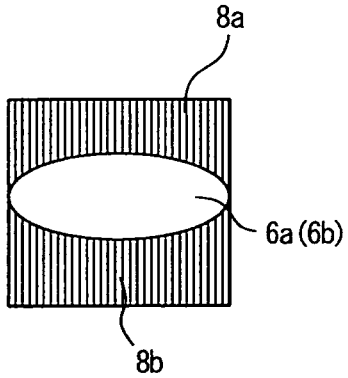

The cut 7 may be provided on the center between the planar seal parts 6*a* and 6*a* (or between 6*b* and 6*b*) in the seal part groups, or may be provided on the position close to one planar seal part 6*a* (6*b*) as shown in FIG. 3(*a*). When the fibers in the sheet-like fibers 5 are cut by providing cut 7 on the position close to one planar seal part 6*a* (6*b*) between the planar seal parts 6*a* and 6*a* (6*b* and 6*b*), the fibers 8*a* on the upper side and the fibers 8*b* on the lower side of the planar seal part 6*a* (6*b*) are formed to have different lengths as shown in FIG. 4. Furthermore, as shown in FIG. 3(*b*), the cuts 7 may be provided on the different positions between the planar seal parts 6*a* (6*b*) in one seal part group. In this case, as shown in FIGS. 5(*a*) to 5(*c*), the length of the fibers 8*a* on the upper side and the length of the fibers 8*b* on the lower side of the planar seal part 6*a*(6*b*) are different for every planar seal part 6*a* (6*b*). When the fibers 8*a* on the upper side and fibers 8*b* on the lower side of the planar seal part 6*a* (6*b*) are constituted so as to have different lengths, the short fibers are excellent in effect of scraping out dirt and dust, and the long fibers are excellent in effect of trapping the dirt and dust that have been scraped out, whereby effect of scraping out and trapping dirt and dust is improved. The brush parts 3 may be formed into cotton-like shape by spreading the fibers in the brush parts 3. The spreading may be performed by a method such as blowing air on the surface of the fibers and scrubbing the surface of the fibers with a brush.

Figures 6A, 6B, 6C:
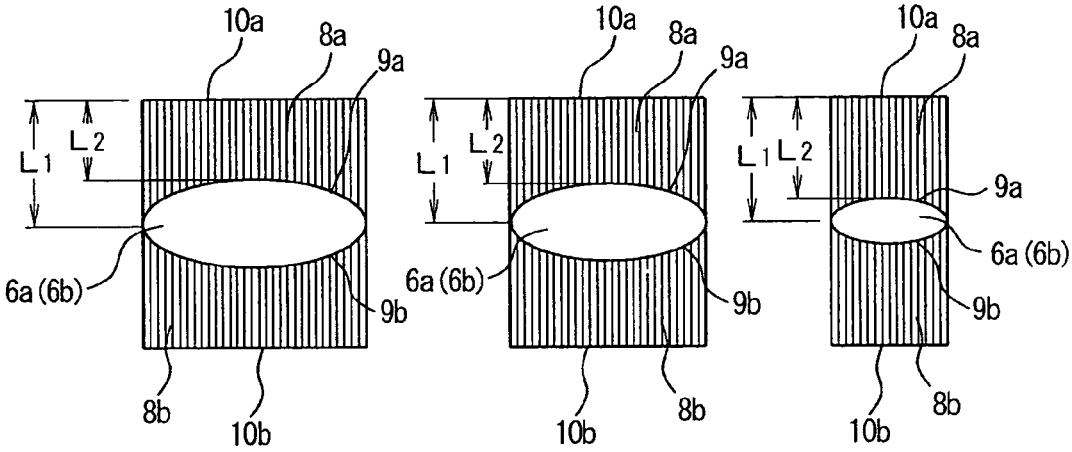
FIG. 6 is an explanatory drawing showing the brush parts formed around the planar seal parts where the planar seal parts having different sizes are disposed.
Figure 7A:
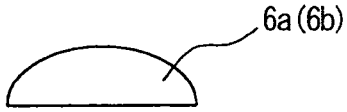
FIG. 7 is an explanatory drawing showing different shapes of the planar seal parts.
Figure 7B:
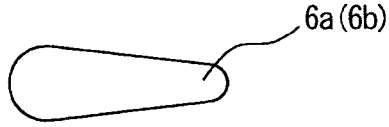
Figure 7C:
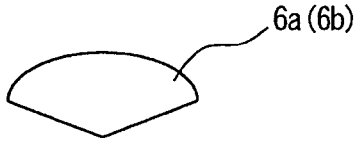
Figure 7D:
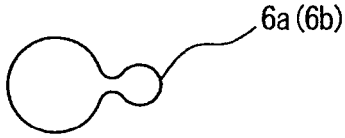
Figure 7E:
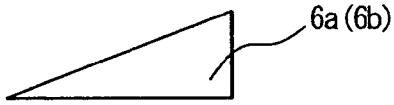
Figure 7F:
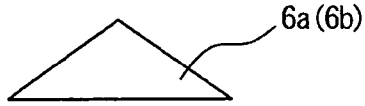
Figure 7G:
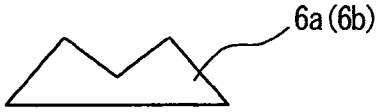
Figure 7H:
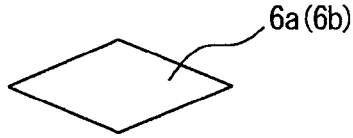
Figure 7I:
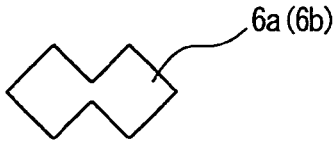
Figure 7J:
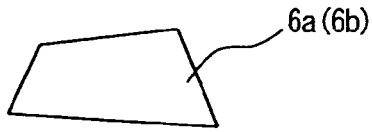

The planar seal parts 6*a* (6*b*) may be formed so that their sizes (areas) are different for every planar seal part 6*a* (6*b*) in the same seal part group, or may be formed so that the sizes of the planar seal parts 6*a* (6*b*) is different in every seal part group. In the latter case, the sizes of the planar seal parts 6*a* (6*b*) in the same seal part group may be the same or different. For example, as shown in FIG. 6, when the planar seal parts are formed so that the planar seal parts have a different area for each seal part group, the brush parts 3 having a different size for every each brush part 3*a* (FIG. 1) are formed. Specifically, when the seal part groups are formed so that the seal part groups positioned more interiorly on the sheet substrate 2 have smaller areas of the planar seal parts 6*a* (6*b*), brush parts 3 having longer fiber length are formed on the brush part lines 3*a* positioned more interiorly on the cleaning sheet 1. Therefore, the outer brush parts 3 having short fiber length can scrape out dirt and dust, whereas the inner brush parts 3 having long fiber length can trap the dirt and dust that cannot be trapped by the outer brush parts 3, whereby cleaning can be performed certainly.

When the planar seal part 6*a* (6*b*) is formed into an oval shape as shown in the above-mentioned example, fibers having mixed various lengths from the longest length: $L_1$ to the shortest length: $L_2$, from the fiber end 10*a* (10*b*) to the fiber seal end 9*a* (9*b*) of the planar seal part 6*a* (6*b*), are formed around the planar seal parts 6*a* (6*b*). Furthermore, when the cuts 7 are provided so that the fiber lengths are different between the upper side and lower side of the planar seal part 6*a* (6*b*), mixed fibers having many more lengths are formed. Therefore, the short fibers scrap out dirt and dust and the long fibers trap the dirt and dust having been scraped out, whereby one brush part 3 has an advantage that it exhibits excellent effects in both scraping out and trapping of dirt and dust.

As the shape of the planar seal part 6*a* (6*b*) that can be formed by providing mixed fibers having various lengths around the planar seal part 6*a* (6*b*), various shapes such as the semi-oval shape as shown in FIG. 7(*a*), the pestle-like shape as shown in FIG. 7(*b*), the fan-like shape as shown in FIG. 7(*c*), the bottle gourd-like shape as shown in FIG. 7(*d*), the triangular shapes as shown in FIGS. 7(*e*) and 7(*f*), the double triangular shape as shown in FIG. 7(*g*), the rhombic shape as shown in FIG. 7(*h*), the double quadrangular shape as shown in FIG. 7(*i*) and the deformed trapezoidal shape as shown in FIG. 7(*j*) can be adopted besides the above-mentioned oval shape. The shapes of the planar seal parts 6*a* (6*b*) may be formed so as to be different for each planar seal part 6*a* (6*b*) in the same seal part group, or may be formed so as to be different for each seal part group, as in the sizes (areas) of the seal parts 6*a* (6*b*). The planar seal parts 6*a* (6*b*) may be formed so as to be different in only shape, or different in only size, or different in both shape and size in the same seal part group or between different seal part groups, or the like.

Figure 9:
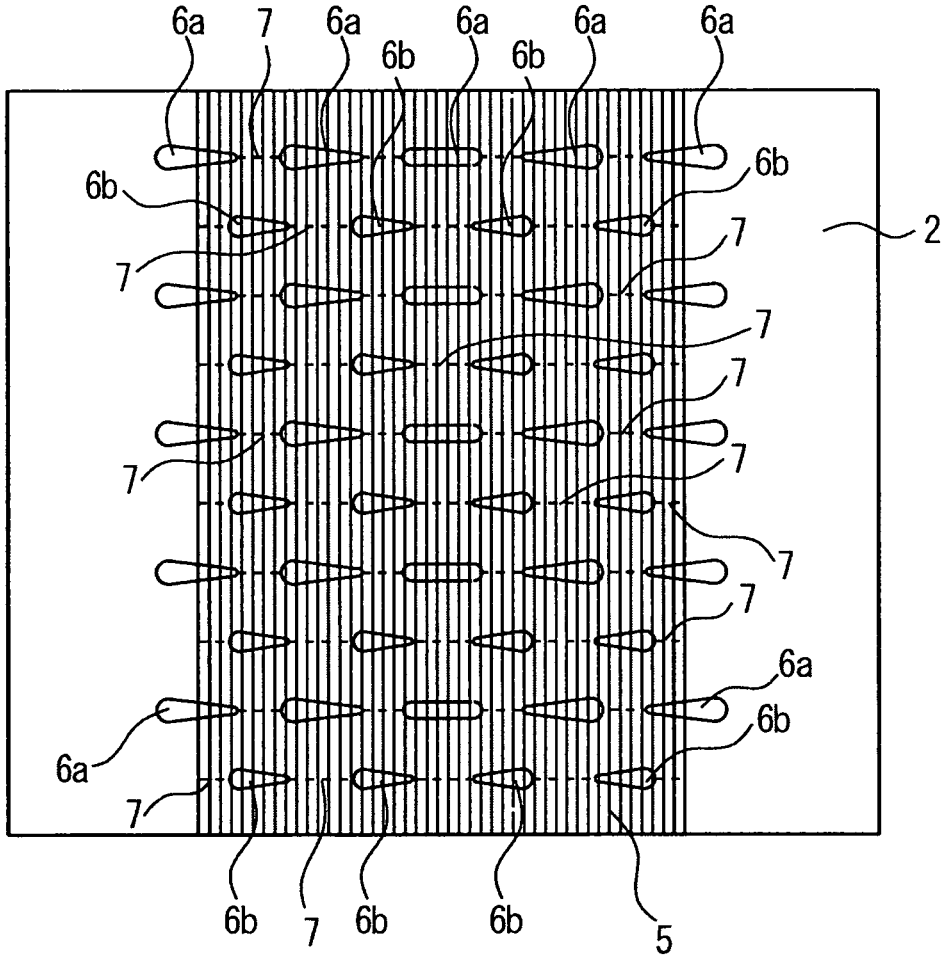
FIG. 9 is a plane drawing showing the production process of the cleaning sheet of the present invention of a different embodiment.

FIG. 9 shows another example of the present invention wherein the first seal part groups and the second seal part groups are disposed so that the planar seal parts 6*a* in the first seal part groups and the planar seal parts 6*b* in the second seal part groups are formed at the positions at which they are mutually overlapped on the upper and lower positions along the fiber direction of the sheet-like fibers 5 to join the sheet substrate 4 and the sheet-like fibers 5. In the example shown in FIG. 9, the brush parts 3 can be formed around the planar seal parts 6*a* by cutting the fibers by providing the cuts 7 between the planar seal parts 6*a* in the two adjacent first seal part groups by which the second seal part group is interposed, in the direction intersecting with the fiber direction of the sheet-like fibers 5 and also the brush parts 3 can be formed around the planar seal parts 6*b* by cutting the fibers by providing the cuts 7 between the planar seal parts 6*b* in the two adjacent second seal part groups by which the first seal part group is interposed, in the direction intersecting with the fiber direction of the sheet-like fibers 5.

Figure 10:
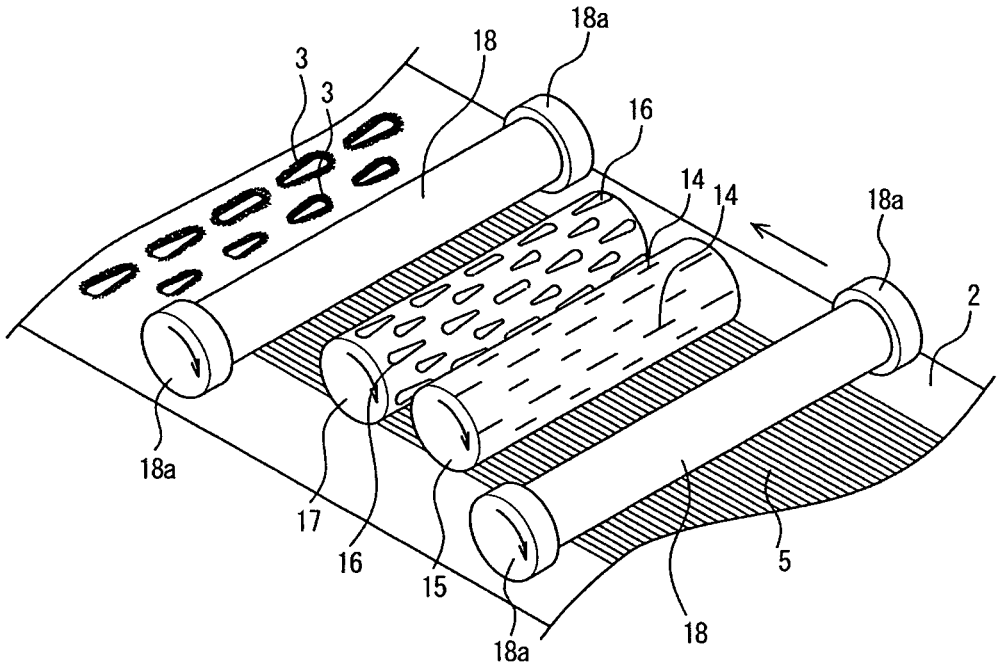
FIG. 10 is a drawing showing one example of the production method of the cleaning sheet of the present invention.

As shown in FIG. 10, the cleaning sheet 1 of the present invention can be produced by a method including providing the cuts 7 on the sheet-like fibers 5 by a cutting roll 15 having cutting blades 14 disposed intermittently and alternately on the circumference surface while transmitting the superposed sheet substrate 2 and sheet-like fiber 5 in the direction of the arrow, and providing the planar seal parts 6*a* and 6*b* on the positions between the cut 7 and cut 7 using a melt adhesion roll 17 having melt adhesion blades 16 disposed intermittently and alternately on the circumference surface, or the like. Although the case where the cuts are first provided by the cutting roll 15 and the planar seal parts are then disposed by the melt adhesion roll 17 is shown in the example shown in FIG. 10, a constitution where the planar seal parts are first disposed by the melt adhesion roll 17 and the cuts are then provided by the cutting roll 15 between the planar seal parts may also be used. Furthermore, the planar seal parts and cuts may be provided simultaneously by using a cut-melt adhesion roll on which cutting blades and melt adhesion blades are disposed alternately on the circumference surface. In FIG. 10, reference numeral 18 represents a transmitting roll having rolls 18*a* that press the both end parts of the sheet substrate 2 to transmit the sheet. When the planar seal parts and cuts are formed by transmitting the superposed sheet substrate 2 and sheet-like fiber 5 using such transmitting roll 18, misalignment between the cuts 7 and the planar seal parts 6*a* (6*b*) is not likely to occur even if the cuts are first provided.

Figure 8:
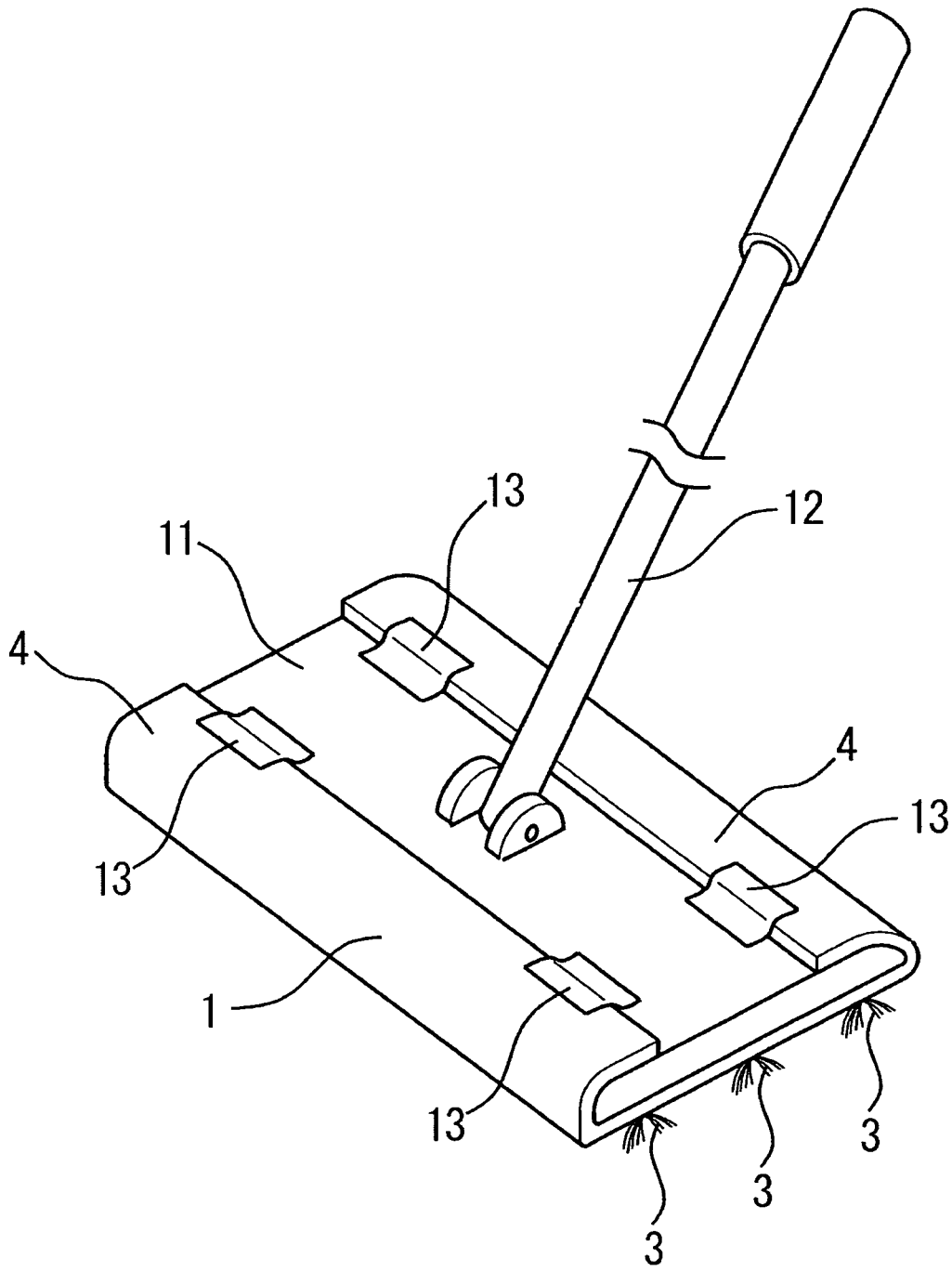
FIG. 8 is a perspective view showing the state where the cleaning sheet of the present invention is attached to a cleaning tool.

The cleaning sheet 1 of the present invention may be used as a floor cleaning tool, for example a cleaning tool having head part 11 and handle 12, wherein attaching parts 4 of the cleaning sheet 1 are fixed by fixing tools 13 of the head part 11 of the cleaning tool so as to attach the cleaning sheet 1 to the head part 11 as shown in FIG. 8. However, the cleaning sheet 1 of the present invention is used not only for cleaning floors but may also be constituted for handy mops. Furthermore, the cleaning sheet 1 of the present invention may be used for a cleaning tool having a glove-like shape, by which cleaning is performed by inserting a hand directly.

The invention claimed is:

1. A cleaning sheet comprising:

a sheet substrate;

a fiber sheet including a plurality of fibers, each of the plurality of fibers extending from the fiber sheet along a same fiber direction; and multiple brush part lines disposed on at least one surface of the sheet substrate, wherein each brush part line has multiple brush parts disposed intermittently along a first direction of the sheet substrate, the multiple brush part lines are disposed in a second direction intersecting with the first direction, and adjacent brush part lines are disposed so that brush parts of adjacent brush part lines are alternately positioned in the fiber direction and a direction orthogonal to the fiber direction; and first seal part groups and second seal part groups, wherein the first seal part groups are provided with multiple planar seal parts disposed intermittently along the fiber direction of the fiber sheet, and the second seal part groups are provided with multiple planar seal parts intermittently disposed and alternately positioned with the planar seal parts of the first seal part groups, the sheet substrate and the fiber sheet are joined together by directing the first seal part groups and the second seal part groups alternately in a direction intersecting with the fiber direction of the fiber sheet, cuts each of which having a width equal to or smaller than a width of the planar seal part are provided between the planar seal parts in each of the seal part groups so as to cut fibers to form each of the brush parts with the fibers having different lengths which are formed in opposing positions around the planar seal parts.

2. The cleaning sheet according to claim 1, wherein fiber sheets are superposed on at least one surface of the sheet substrate, the first seal part groups in which each group comprises multiple planar seal parts disposed intermittently along a fiber direction of the fiber sheets, and second seal part groups, in which each group comprises planar seal parts disposed intermittently on positions intersecting with the planar seal parts of the first seal part groups, are disposed in an alternate manner in a direction intersecting with the fiber direction of the fiber sheets to join the sheet substrate and the fiber sheets, cuts each having a width similar to or lower than a width of the planar seal parts on the second seal part groups in which each group is interposed between the first seal part groups, are provided between the planar seal parts on the adjacent two first seal part groups by which the second seal part group is interposed, in a direction intersecting with the fiber direction of the fiber sheets to form the brush parts around the planar seal parts; and the cuts each having a width similar to or lower than a width of the planar seal parts on the first seal part groups in which each group is interposed between the second seal part groups, are provided between the planar seal parts on adjacent two second seal part groups by which the first seal part group is interposed, in a direction intersecting with the fiber direction of the fiber sheets to form the brush parts around the planar seal parts.

3. The cleaning sheet according to claim 1, wherein the first seal part groups and the second seal part groups are disposed so that the planar seal parts on the first seal part groups and the planar seal parts on the second seal part groups are formed on the positions that are mutually partially overlapped on upper and lower positions along the fiber direction of the fiber sheets.

4. The cleaning sheet according to claim 1, wherein the brush parts are formed bulky by raising the fibers in the brush parts after formation of the brush parts around the seal parts.

5. The cleaning sheet according to claim 1, wherein the sheet substrate and the fiber sheets are joined by disposing planar seal parts having different sizes.

6. The cleaning sheet according to claim 5, wherein the planar seal parts have different sizes along the fiber direction of the fiber sheets.

7. The cleaning sheet according to claim 5, wherein the planar seal parts have different sizes in the direction intersecting with the fiber direction of the fiber sheets.

8. The cleaning sheet according to claim 1, wherein the planar seal parts each have an oval shape.

9. The cleaning sheet according to claim 1, wherein the first seal part groups and the second seal part groups are disposed so that the planar seal parts on the first seal part groups and the planar seal parts on the second seal part groups are formed on positions that are mutually partially overlapped on the upper and lower positions along the fiber direction of the fiber sheets.

10. The cleaning sheet according to claim 1, wherein the planar seal parts have different sizes along the fiber direction of the fiber sheets.

11. The cleaning sheet according to claim 1, wherein the planar seal parts have different sizes in a direction intersecting with the fiber direction of the fiber sheets.

12. The cleaning sheet according to claim 1, wherein the brush parts are formed of fibers surrounding an entirety of a bond line of the planar seal parts.

13. The cleaning sheet according to claim 8, wherein minor axes of the planar seal parts are in parallel to the fiber direction, and each of the brush parts is formed around each of the planar seal parts by cutting between the planar seal parts of each of the seal part groups in a direction parallel to a major axis of the planar seal parts.

14. The cleaning sheet according to claim 2, wherein the brush parts of the first seal part group and the brush parts of the second seal part group respectively adjacent to the brush parts of the first seal part group are formed in such a manner that fibers of the brush parts are mutually overlapped.

15. The cleaning sheet according to claim 14, wherein the brush parts are formed bulky by raising the fibers in the brush parts after formation of the brush parts around the seal parts.

16. The cleaning sheet according to claim 14, wherein the sheet substrate and the fiber sheets are joined by disposing planar seal parts having different sizes.

* * * * *